United States Patent [19]

Nitta

[11] Patent Number: 4,878,834

[45] Date of Patent: Nov. 7, 1989

[54] GASLIGHTER STRUCTURE

[75] Inventor: Tomio Nitta, Yokohama, Japan

[73] Assignee: Tokai Corporation, Yokohama, Japan

[21] Appl. No.: 344,347

[22] Filed: Apr. 28, 1989

[30] Foreign Application Priority Data

May 11, 1988 [JP] Japan ..... 63-61047[U]

[51] Int. Cl.[4] ..... F23Q 25/00

[52] U.S. Cl. ..... 431/152; 431/144; 431/146

[58] Field of Search ..... 431/135, 129, 146, 152, 431/144, 264, 274, 277, 273; 206/242

[56] References Cited

U.S. PATENT DOCUMENTS 1,762,980 6/1930 Hardy ..... 431/152 X 2,529,094 11/1950 Miller ..... 431/277 X

FOREIGN PATENT DOCUMENTS 930249 1/1948 France ..... 431/152

*Primary Examiner*—Randall L. Green

*Attorney, Agent, or Firm*—Armstrong, Nikaido, Marmelstein, Kubovcik & Murray

[57] ABSTRACT

Disclosed is an improvement of gaslighter structure which has, in the hollow cylinder space at the rear portion of the housing; a push rod having hooks integrally connected to its opposite sides. The push rod is spring-biased upwards, and is pushed against the support piece of the cap, thereby permitting the cap to click shut and open. This arrangement permits necessary parts including a spring to be assembled in a cap pivot-and-latch simply by thrusting them in the rear space of the housing. This reduces the difficulty which otherwise, workers would encounter in assembling parts including a resilient element in a relatively small space. Also, the work of pivoting the cap to the housing can be advantageously separated from the work of assembling pivot-and-latch parts.

2 Claims, 4 Drawing Sheets

GASLIGHTER STRUCTURE

BACKGROUND OF THE INVENTION

1. Field of the Invention

The present invention relates to a gaslighter equipped with a push-rod type latch on which a cap turns, particularly to an improved gaslighter structure which permits latch parts including a spring to be assembled with ease.

2. Related Art

In general, a gaslighter is composed of many parts. As a tendency the size and weight of the gaslighter are reduced, and accordingly the size of parts are reduced. Such parts of reduced size are assembled into gaslighter with the hands.

FIG. 5 shows a conventional gaslighter equipped with a push-rod type latch. It uses a "T"-shaped push rod 105 with a spring 104 around its leg. The combination of the push rod 105 and the spring 104 is inserted in the longitudinal space 103 on the rear side of a housing 1 until the spring 104 reaches the bottom of the longitudinal space 103. Thus, the push rod 105 is resiliently held so as to move vertically in the longitudinal space 103. Then, the support piece 107 of a cap 106 is inserted in the longitudinal space 103 to push down the push rod 105 until the through aperture 108 of the support piece 107 is put in alignment with the through apertures 101 of the opposite rear, top extensions of the housing 100. Then, a pivot pin 102 is inserted in these aligned apertures 102 and 108. Thus, the cap 106 is pivoted to the housing 100.

In assembling the spring 104, the push rod 105, the support piece 107 of the cap 106 and the pivot pin 102 to the latch pivot with the hands, the spring 104 cannot be tentatively held before and while assembling, and therefore, these parts must be assembled together simultaneously in one step. The simultaneous assembling of small-sized parts while pressing the resilient element, is a time-consuming and difficult work, and is one cause for preventing the improvement of the efficiency with which gaslighters are manufactured.

SUMMARY OF THE INVENTION

In view of the above one object of the present invention is to provide a gaslighter structure which permits necessary parts including a spring to be assembled to a push-rod type latch with ease, accordingly improving the efficiency with which gaslighters are made.

To attain this object a gaslighter which comprises: a lighter body comprising a housing having a built-in gas container to be filled with a liquefield petroleum gas, a nozzle assembly fixed to the top plate of said housing and cap pivot-and-latch provided to the rear, top of said housing; a flint unit comprising a mount having a cover fitted thereon, said cover having a flame aperture made in its front, a flint mechanism in the vicinity of said flame aperture and a conduit opening at its front end in the vicinity of said flame aperture, extending under said mount and connected to said nozzle assembly; and a cap having a support piece at its rear end, said cap being fixed to said cap pivot-and-latch to turn about its pivot and cover said flint unit when closed, is improved according to the present invention in that said cap pivot-and-latch comprises, in the hollow cylinder space defined by the inner wall of the rear portion of said housing and the rear side of the top plate of said housing, a push rod having hooks integrally connected to its opposite sides to be caught by the lower edge of the top plate of said housing, and an associated spring, said push rod being spring-biased upwards and pushed against said support piece of said of said cap, thereby permitting said cap to click shut and open. The push rod may comprise a central leg, two opposite side legs and a horizontal base having an inclined top, all legs being integrally connected to the horizontal base. Each side leg may have a hook integrally connected to its side, and an associated spring may be loosely fitted around the central leg.

This arrangement permits a spring and a push rod to be assembled in a push-rod type latch simply by thrusting the spring-and-push rod combination in the longitudinal space at the rear, top of the housing unit the push rod is caught by its hooks in the housing, not requiring the simultaneous attachment of the support piece of the cap as is the case in the conventional gaslighter.

Other objects and advantages of the present invention will be understood from the following description of a galsighter according to one preferred embodiment of the present invention, which is shown in the accompanying drawings:

BRIEF DESCRIPTION OF THE DRAWINGS

FIG. 4A is an exploded view of the gaslighter whereas FIG. 5A is a perspective view of the push rod type latch of a conventional gaslighter whereas

PREFERRED EMBODIMENT OF THE INVENTION

Figure 3:
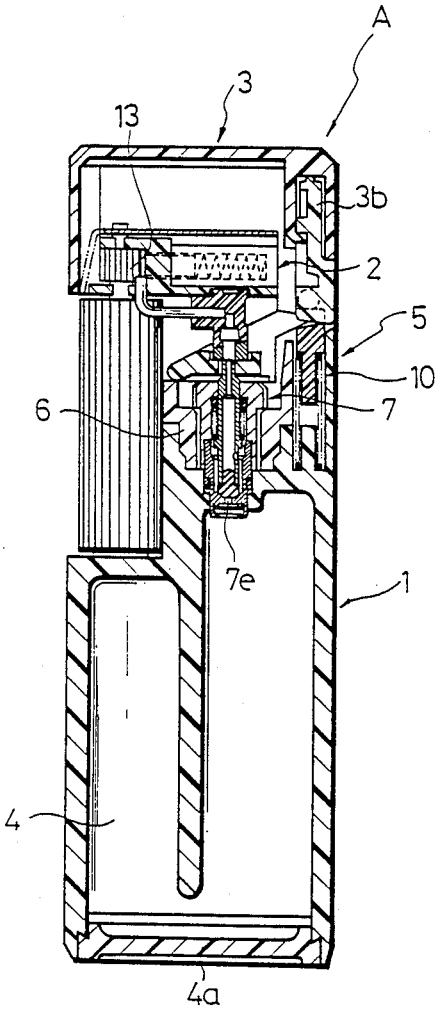
FIG. 3 is a longitudinal section of the gaslighter according to the present invention.

FIG. 3 shows a gaslighter A according to one embodiment of the present invention as comprising a lighter body 1, a flint unit 2 and a cap 3. The lighter body 1 is of a synthetic resin mold, comprising a gas container 4 to be filled with a liquefied petroleum gas, a nozzle assembly 7 fixed to the top plate 6 of the housing and cap pivot-and-latch 5 provided to the rear, top of the housing. The housing has a bottom plate 4*a*.

Figure 4A:
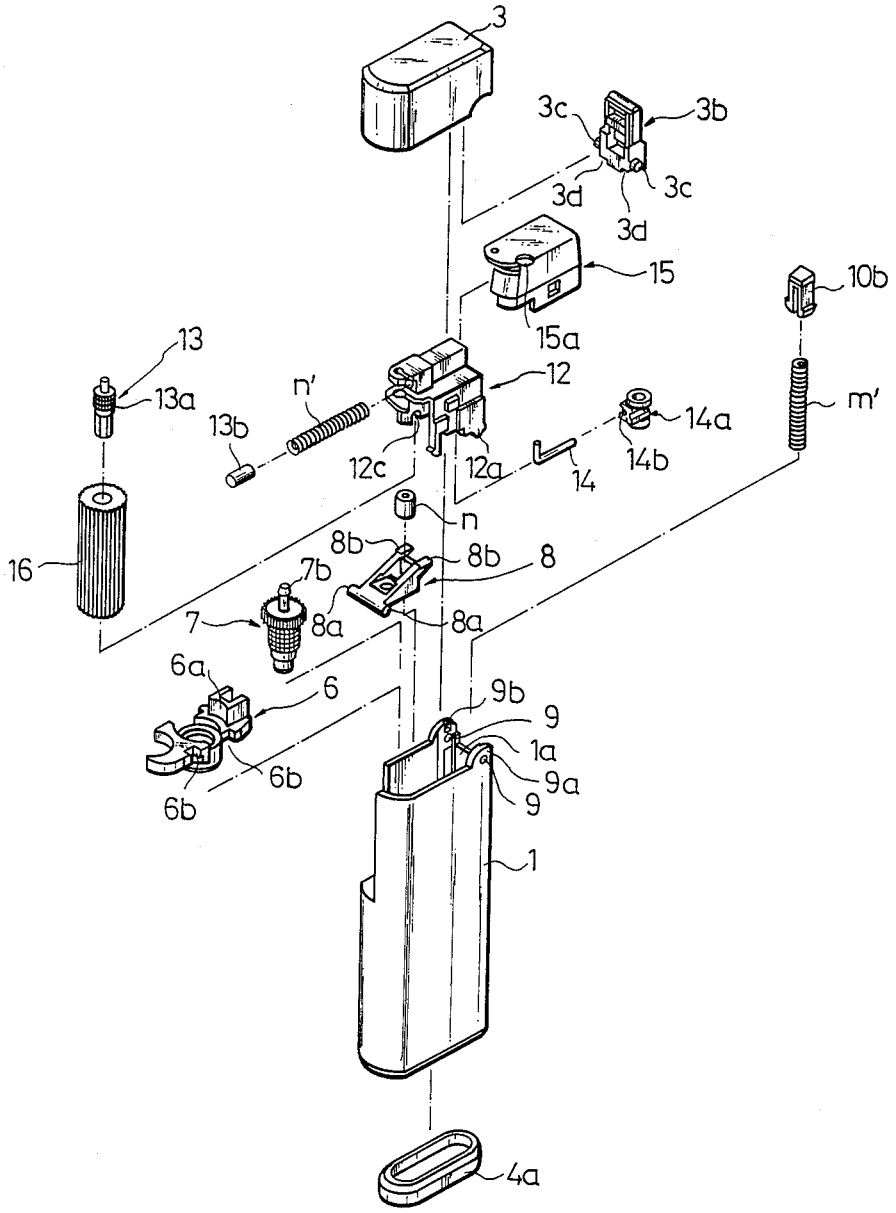
Figure 5A:
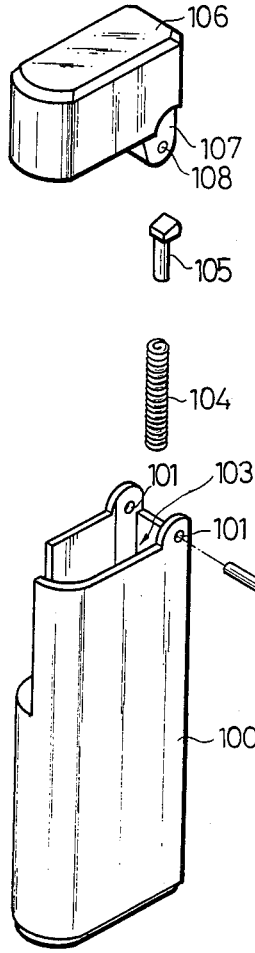
FIG. 5A PRIOR ART
Figure 5B:
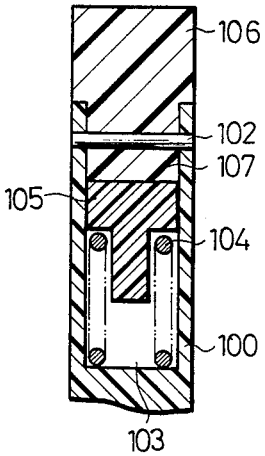
FIG. 5B PRIOR ART
FIG. 5B is a longitudinal section thereof.
Figure 4B:
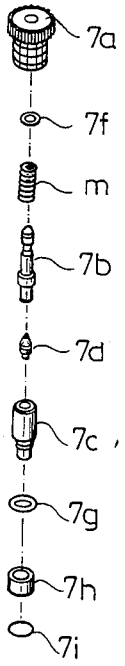
FIG. 4B is an exploded view of a nozzle assembly.

As shown in FIG. 4, the nozzle assembly 7 comprises an outer casing 7*a*, a tapped O-ring 7*f*, a spring (m), a gas ejection pipe 7*b*, a rubber plug 7*d*, an inner cylinder 7*c*, an O-ring 7*g*, a thermal adhesion pipe 7*h* and a filter 7*i*. The gas ejection pipe 7*b* is movably fitted in the outer casing 7*a* and partly appearing above the outer casing 7*a*. The nozzle assembly 7 is fixed to the top plate 6 with the outer casing 7*a* threadedly engaged with the tapped aperture of the top plate 6 and with the inner cylinder 7*c* communicating with the inside of the gas container 4. The gas ejection pipe 7*b* is biased downwards by the spring (m') to keep the rubber plug 7*b* closing the bottom aperture 7*e* of the inner cylinder 7*c*.

A lever 8 looks like a gun carriage. It has two pivot pins 8*a* integrally connected to the opposite sides of its front end, two engagement pieces 8*b* integrally connected to its rear, upper end and an aperture in its bottom. The top end of the ejection nozzle 7*b* is inserted in the aperture of the lever 8, and is fixed to the lever 8 by a rubber ring (n).

A cap pivot-and-latch 5 is provided to the rear, top of the housing. The housing has two opposing elongations 9a integrally connected to its rear, top portion. Each elongation, somewhat flexible, has a through aperture 9 and a notch 9b inside. The notch extends from the top end of the elongation and its reaches short of the aperture 9. The support piece 3b of the cap 3 is pivoted to the rear elongations 9a as later described.

The cap pivot-and-latch 5 comprises, in the hollow cylinder space 10a defined by the inner wall 1a of the rear portion of the housing and the rear wall 6a of the top plate 6, a push rod 10b having hooks 10c integrally connected to its opposite sides to be caught by the bottom edge of the top plate 6, and an associated spring (m'). The push rod 10b is spring-biased upwards to be pushed against the support piece 3b of the cap 3, thereby permitting the cap 3 to click shut and open.

Figure 1:
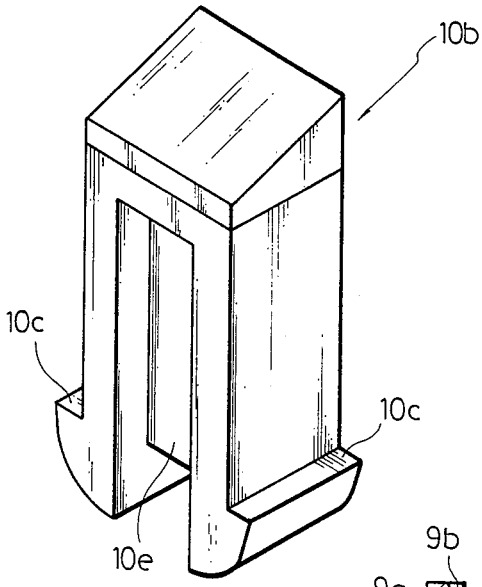
FIG. 1 is an enlarged perspective view of a push rod, which is used in a gaslighter according to the present invention.
Figure 2:
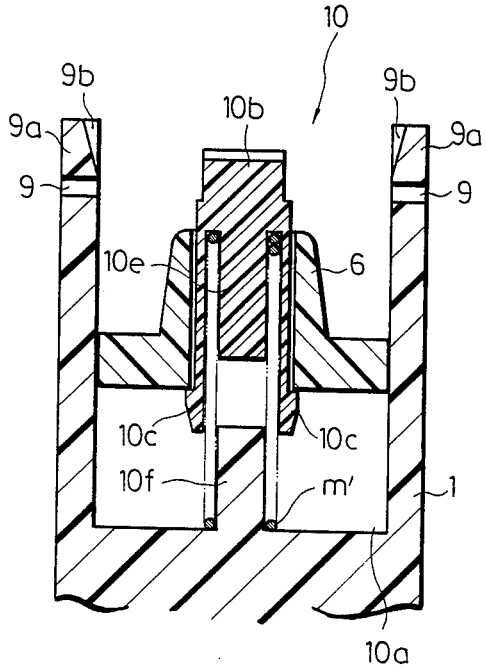
FIG. 2 is a longitudinal section showing how the push rod is fitted in the housing.

As best shown in FIGS. 1 and 2, the push rod 10b is generally in the form of the letter "E", comprising a central leg 10e and two opposite side legs and a horizontal base having an inclined top, all legs being integrally connected to the horizontal base. Each side leg has a hook 10c integrally connected to its side, and the spring (m') is loosely fitted around the central leg 10e. A counter projection 10f is integrally connected to the bottom of the hollow cylinder space 10a.

The flint unit 2 comprises a mount 12 having a cover 15 fitted thereon, a flint mechanism 13 arranged in the vicinity of the flame aperture 15a of the cover 15, and a conduit 14 opening at its front end in the vicinity of the flame aperture 15a, extending under the mount 12 and connected to the gas ejection pipe 7b of the nozzle assembly 7 via a connecting piece 14a.

The mount 12 is synthetic resin mold having a generally "U"-shape. It has three hooks 12a on its lower edge. It is fixed to the top plate 6 with its hooks 12a caught by the notches 6b of the top plate 6.

The mount 12 has two semicircular recesses 12b on its lower front edge. The lever 8 is rotatably fixed to the mount 12 with its pivot pins 8a in the semicircular recesses 12b of the mount 12. The ejection nozzle 7b is fixed to the lever 8 as described earlier. When the lever 8 is pushed down to rotate about its pivot 8a, the ejection nozzle 7b is raised to permit the ejection of gas from the nozzle point. The cover 15 is put on the mount 12 with its flame aperture 15a close to the front end of the L-shaped conduit 14. The rear end of the conduit 14 is inserted in the through hole 14b of the connector metal 14a, and the tip end of the ejection nozzle 7b is inserted in the through hole 14b, too.

The flint mechanism 13 comprises a flint wheel 13a and a flint 13b. The flint wheel 13a is located in the vicinity of the flame aperture 15a of the cover 15. The flint 13b is biased by a spring (n') to be pushed against the flint wheel 13a all the time.

A rotatable cylinder 16 is connected to the flint wheel 13a. Rotation of the rotatable cylinder 16 causes the flint wheel 13a to rotate for striking fire, thereby setting on fire when the gas ejects from the tip end of the conduit 14.

The flint unit 2 is made up by the mount 12 with its cover 15 put thereon, the flint mechanism is located in the vicinity of the flame aperture 15a of the cover 15 and the conduit 14 opening at its front end in the vicinity of the flame aperture 15a, and extending under the mount 12. The flint unit 2 is push-fitted in the top space of the housing until the hooks 12a of the mount 12 are caught by the notches 6b of the top plate 6. At the same time, a pin 16a standing upright on the shoulder of the housing is loosely inserted in the counter recess made in the bottom of the rotatable cylinder 16. Thus, the rotatable cylinder 16 is rotatably fixed to the gaslighter body 1.

The support piece 3b is push-fitted and fixed to the rear side of the cap 3. The opposite projections 3c of the support piece 3b are inserted in the slots 9b of the rear elongations 9a of the housing. The rear elongations 9a will be yieldingly bent outwards to allow the pivot axles 3c to go to and fall in the apertures 9 of the rear elongations 9a. Then, the bottom of the support piece 3b sits on the inclined top of the push rod 10b. Thus, the cap 3 is pivoted to the housing.

The support piece 3b has engagement notches 3d on its lower corners to catch the rear extensions 8b of the lever 8 for turning the lever 8 upwards when the cap 3 opens.

As described above, a gaslighter according to the present invention has, in the hollow cylinder space defined by the inner wall of the rear portion of the housing and the rear side of the top plate of the housing, a push rod having hooks integrally connected to its opposite sides. The push rod is spring-biased upwards, and is pushed against the support piece of the cap, thereby permitting the cap to click shut and open. This arrangement permits necessary parts including a spring to be assembled in a cap pivot-and-latch simply by thrusting them in the rear space of the housing. This reduces the difficulty which otherwise, workers would encounter in assembling parts including a resilient element in a relatively small space. Also, the work of pivoting the cap to the housing can be advantageously separated from the wrok of assembling pivot-and-latch parts. This contributes the improvement of the assembling efficiency.

I claim:

1. A gaslighter which comprises: a lighter body comprising a housing having a built-in gas container to be filled with a liquefied petroleum gas, a nozzle assembly fixed to a top plate of said housing and a cap pivot-and-latch provided to the rear, top of said housing; a flint unit comprising a mount having a cover fitted thereon, said cover having a flame aperture made in its front, a flint mechanism in the vicinity of said flame aperture and a conduit opening at its front end in the vicinity of said flame aperture, extending under said mount and connected to said nozzle assembly; and a cap having a support piece at its rear end, said cap being fixed to said cap pivot-and-latch to turn about its pivot and cover said flint unit when closed, characterized in that said cap pivot-and-latch comprises, in the hollow cylinder space defined by the inner wall of the rear portion of said housing and the rear side of the top plate of said housing, a push rod having hooks integrally connected to its opposite sides to be caught by the lower edge of the top plate of said housing, and an associated spring, said push rod being spring-biased upwards and pushed against said support piece of said cap, thereby permitting said cap to click shut and open.

2. A gaslighter according to claim 1 wherein said push rod comprises a central leg and two opposite side legs and a horizontal base having an inclined top, all legs being integrally connected to the horizontal base, each of said side legs having a hook integrally connected to its side, and said associated spring being loosely fitted around said central leg.

* * * * *